United States Patent [19]

Ramm

[11] 3,973,879

[45] Aug. 10, 1976

[54] LIQUID RING COMPRESSOR

[75] Inventor: Claus Ramm, Stein near Nurnberg, Germany

[73] Assignee: Siemens Aktiengesellschaft, Munich, Germany

[22] Filed: Feb. 18, 1975

[21] Appl. No.: 550,282

[30] Foreign Application Priority Data

Mar. 13, 1974 Germany ..... 2412095

[52] U.S. Cl. ..... 417/69; 417/79; 417/87

[51] Int. Cl.[2] ..... F04C 19/00; F04B 23/04

[58] Field of Search ..... 417/69, 87, 79, 68

[56] References Cited

UNITED STATES PATENTS

| | | | |
|---|---|---|---|
| 3,315,879 | 4/1967 | Jennings | 417/87 X |
| 3,481,529 | 12/1969 | Mugele | 417/69 X |
| 3,575,532 | 4/1971 | Mugele et al. | 417/69 |
| 3,642,384 | 2/1972 | Huse | 417/69 X |

FOREIGN PATENTS OR APPLICATIONS

| | | | |
|---|---|---|---|
| 432,721 | 8/1926 | Germany | 417/69 |

*Primary Examiner*—Carlton R. Croyle
*Assistant Examiner*—Richard E. Gluck
*Attorney, Agent, or Firm*—Kenyon & Kenyon Reilly Carr & Chapin

[57] ABSTRACT

In a liquid ring compressor with a liquid separator which has a liquid take-off point in its housing which is fed by the liquid ring co-rotating with the impeller and connected through connecting lines outside the housing to internal auxiliary liquid circuits, a liquid jet pump is installed in the connecting line and supplied with operating fluid from the liquid take-off point and is used to return liquid which is separated from the compressed gas at least during the start up of the compressor.

3 Claims, 4 Drawing Figures

LIQUID RING COMPRESSOR

BACKGROUND OF THE INVENTION

This invention relates to liquid ring compressors in general and more particularly to an improved arrangement for insuring sufficient liquid during start up in a compressor having a liquid separator.

Liquid ring compressors are well known in which a ring of liquid co-rotates with an impeller eccentrically disposed within a housing to obtain the necessary pumping action to compress the gas. In such compressors, it is well known to provide liquid take-off points which are acted upon by the ring of liquid to supply liquid to auxiliary liquid circuits through external connecting lines. These auxiliary liquid circuits are used to seal gaps between the impeller and housing, to lubricate shaft seals if necessary and to replace the portion of the operating liquid which is carried off with the compressed gas and is not separated out. This operating liquid maintains the required liquid ring within the housing and cools the housing. This is necessary since the liquid ring absorbs the major portion of the compressor power and is heated up in the process.

In liquid ring compressors which operate using expensive or environmental polluting operating liquids, an operating liquid circuit is generally provided in which the liquid which is expelled along with the pumped gas is completely returned to the compressor through the use of a heat exchanger. In other words a liquid separator is provided at the discharge of the compressor to separate the liquid in the gas and return it to the compressor.

Normally this return is accomplished by means of the compressor suction. In such a system, after the compressor is stopped only a portion of operating liquid remains in the housing, which portion is sufficient, upon restarting, to form a thin but operative liquid ring. However, due to the fact that a portion of the operating liquid is carried away with the gas being compressed, this thin liquid ring can be further thinned within a short period of time to the point where the liquid ring is no longer in engagement with the impeller resulting in a sudden cessation of the output. This results directly from the fact that during start up the suction is not sufficient to draw back into the compressor the separated liquid from the liquid separator. To overcome this problem it has been typical in the prior art to provide separately driven circulating pumps e.g. centrifugal pumps, in the circuit between the liquid separator and the compressor. However, such pumps require maintenance, are expensive and take up space.

In view of this, it is the object of the present invention to provide, in a simple fashion, without the need for separately driven pumps with moving parts, perfect starting and continuous operation of the type of compressor described above.

SUMMARY OF THE INVENTION

The present invention provides a solution to this problem. This is accomplished by placing in an external connecting line, which is supplied with operating liquid from a liquid take-off point, a liquid jet pump which is supplied by that liquid and which is used to draw the separated liquid from the liquid separator and return it through the connecting line to the compressor In accordance with the disclosed emobodiment the jet pump is operable at least during the starting phase of the liquid ring compressor.

DETAILED DESCRIPTION OF THE PREFERRED EMBODIMENT

Figure 1:
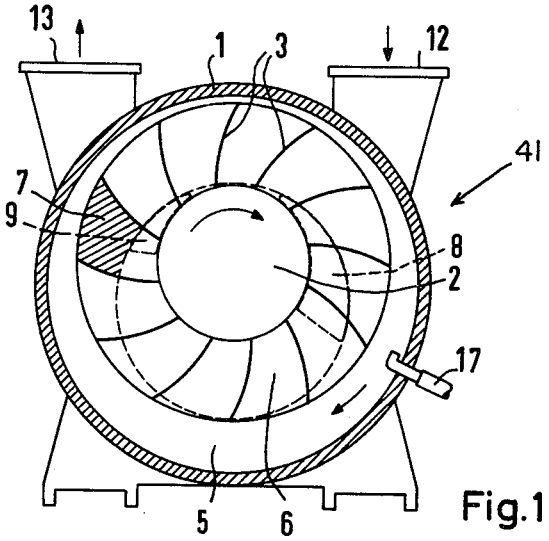
FIG. 1 is a cross sectional elevation view of a single stage liquid-ring compressor having scoop tubes installed.
Figure 2:
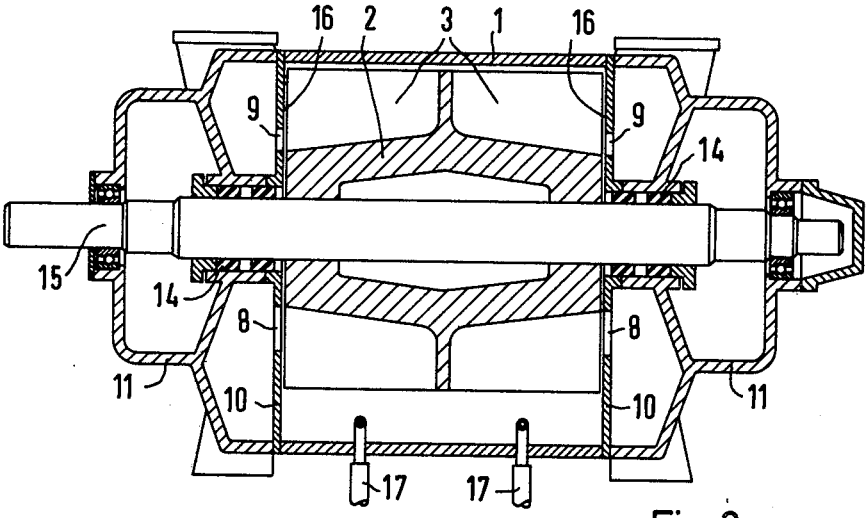
FIG. 2 is a longitudinal cross section through the compressor of FIG. 1.

FIGS. 1 and 2 illustrate a single stage liquid ring compressor 41 having a liquid takeoff or scoop tube associated therewith. As illustrated, a circular rotor 2 having forwardly curved blades 3 is arranged eccentrically within a circular housing part 1. As the rotor rotates, a liquid ring 5 (the inner contour of the liquid ring is shown as dashed) surrounds the impeller 2 and its blades 3 eccentrically at its circumference 4. Thus, in the individual impeller cells 6, liquid pistons of different depths of penetration, one of which is shown shaded, result causing gas to be drawn in through lateral suction slots 8 and to be exhausted through lateral pressure slots 9 in a well known manner. The suction and pressure slots are located in two control discs 10 which laterally terminate the housing part 1. On the outside, these control discs communicate with distributors 11 having suction and pressure nozzles 12, and 13, i.e. a gas inlet and outlet, respectively coupled thereto. Within the distributors 11 are also contained the shaft seals 14 and the bearings for the impeller shaft 15. For cooling and sealing, auxiliary liquid, which is taken from a liquid ring 5, is supplied under pressure in a well known manner through internal auxiliary circuits to the shaft seals 14 and the lateral gaps 16 between the control discs 10 and the impeller 2 at the indicated points. In order to obtain the necessary flow at a sufficient pressure, liquid takeoffs designated 17 are arranged at the circumference of the housing part 1 in the suction zone of the liquid ring 5. These are arranged so that they are situated outside of secondary flow lines, not shown, which means that they are attached in a direction of the axis between the center of the housing point and the control discs 10 on a line parallel to the axis.

Figure 3:
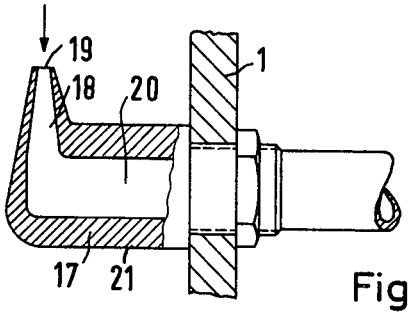
FIG. 3 is an illustration partially in cross section of the scoop tube of FIG. 1.

In order that these takeoffs 17 convert the velocity of the rotating liquid ring into the highest possible pressure in the liquid taken off and to minimize the flow losses due to the flow around the liquid takeoffs 17, a design illustrated by FIG. 3 is used. The takeoff 17 is in the form of a scoop tube which is streamline in the flow direction as illustrated by the cross section 21. The tip of the scoop tube is expanded in the manner of a diffusor in the direction of rotation indicated by the arrow as indicated by the inside portion 18 starting from its inlet opening 19. If expands to the desired diameter 20 shown on the cross section 21 in a transversal part. In this manner, sufficient amounts of liquid are taken off at a high enough pressure that auxiliary pumps are not necessary.

Figure 4:
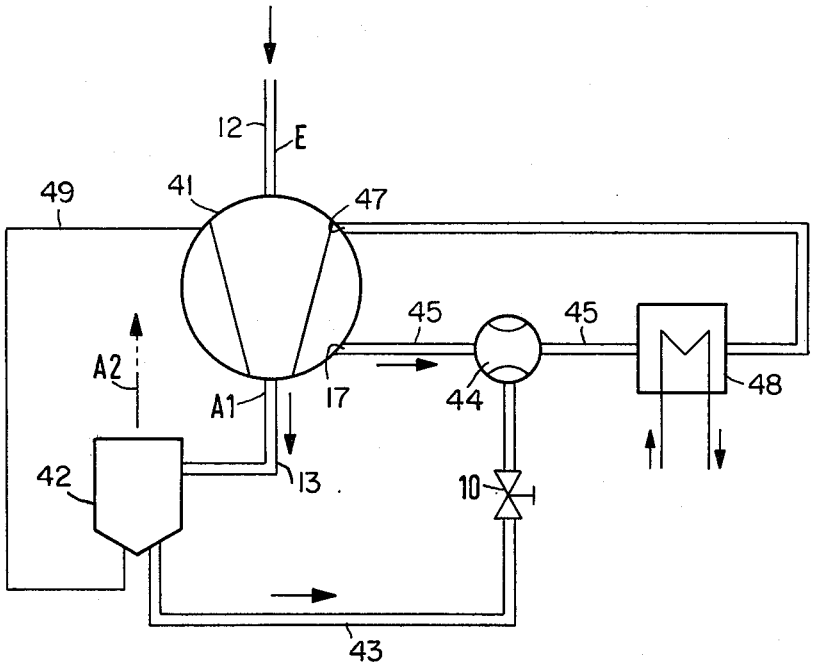
FIG. 4 is a schematic illustration of the liquid ring compressor of the present invention.

FIG. 4 illustrates a liquid ring compressor such as that of FIGS. 1–3 which has associated therewith the arrangement of the present invention.

As illustrated schematically on FIG. 4, a liquid ring compressor 41 has a gas inlet where it draws in a gas E and after compression discharges it as a gas A1 to a liquid separator 42 where the liquid carried along with the gas is separated from the gas. During normal operation of the compressor the separated liquid is sucked back into the compressor through a line or circuit 49. However, during start up, suction is insufficient to draw the separated liquid back into the compressor. Also associated with the liquid ring compressor 41 is a liquid takeoff point 17 which may be a scoop pipe or the like inserted in the periphery of the co-rotating liquid ring. The liquid picked up by the take-off point is conducted through a circuit 45 back to an inlet 47. Such a circuit is typically used for sealing gaps, lubrication and so on. The circuit 45, as illustrated, passes through a heat exchanger 48 which is used to cool the liquid passing through the circuit.

In accordance with the present invention, a liquid jet pump 44 is inserted into the circuit 45 and obtains its operating liquid therefrom. Through a line 43, the jet pump is connected to the outlet of the liquid separator 42. In this manner as soon as operation begins, the jet pump, due to the liquid flowing therethrough from the take-off point 17, will draw the liquid from the liquid separator 42 through the circuit 43 and carry it along and back into the liquid ring compressor 41. In the illustrated embodiment a valve 50 is provided, which valve will be opened during the start up phase when suction is insufficient to draw the separated liquid back through the circuit 49. Once suction is sufficient this valve can be closed. However, the system can equally well be operated without a valve or with the valve opened at all times.

Thus, an improved arrangement for use in a liquid ring compressor which permits reliable start-up without the need for separately driven pumps with moving parts has been shown. Although a specific embodiment has been illustrated and described, it will be obvious to those skilled in the art that various modifications may be made without departing from the spirit of the invention which is intended to be limited solely by the appended claims.

I claim:

1. In a liquid ring compressor comprising a. a stationary housing having a compressed gas outlet and a gas inlet;

b. an impeller disposed for rotation in the said housing and surrounded by a co-rotating eccentric liquid ring;

c. a liquid take-off point disposed within said housing at a position where it is acted upon by the liquid ring;

d. internal auxiliary liquid circuits in said compressor for sealing;

e. at least one external connecting line coupling said liquid take-off point to one of said internal auxiliary liquid circuit to thereby supply liquid from said ring to said internal auxiliary liquid circuit; and f. a liquid separator for separating out liquid carried along with gas compressed by the compressor coupled to said gas outlet of said compressor, the improvement comprising:

g. a liquid jet pump having a suction input, a jet input and an output disposed in said at least one external connecting line with its jet input coupled to said liquid take-off point and its suction input coupled to the liquid output of said liquid separtor, whereby the liquid from said liquid separator will be returned through said connecting line to the compressor.

2. Apparatus as in claim 1 and further including a valve in the line connecting said liquid separator and said liquid jet pump.

3. Apparatus according to claim 1 wherein the liquid take-off point in said compressor is in the form of a scoop tube.

* * * * *